US011534371B2

(12) United States Patent
Moore

(10) Patent No.: US 11,534,371 B2
(45) Date of Patent: Dec. 27, 2022

(54) SUPPLEMENT DISPENSING MOUTHGUARD DEVICE

(71) Applicant: Energy Guards LLC, Aubrey, TX (US)

(72) Inventor: Rory Calvin Moore, Aubrey, TX (US)

(73) Assignee: ENERGY GUARDS LLC, Aubrey, TX (US)

( * ) Notice: Subject to any disclaimer, the term of this patent is extended or adjusted under 35 U.S.C. 154(b) by 364 days.

(21) Appl. No.: 17/024,526

(22) Filed: Sep. 17, 2020

(65) Prior Publication Data

US 2021/0077355 A1 Mar. 18, 2021

Related U.S. Application Data

(60) Provisional application No. 62/901,688, filed on Sep. 17, 2019.

(51) Int. Cl.
*A61J 7/00* (2006.01)
*A63B 71/08* (2006.01)

(52) U.S. Cl.
CPC ..... *A61J 7/0053* (2013.01); *A63B 71/085* (2013.01); *A63B 2071/086* (2013.01)

(58) Field of Classification Search
CPC ..... A61J 7/0053; A61J 7/00; A63B 71/085; A63B 71/08; A63B 2071/086; A63B 2071/088; A61B 5/1072; A61B 5/1076; A61B 5/481; A61B 17/8071; A61B 5/4812; A61B 5/4818; A61B 5/7275; A61B 5/4557; A61B 5/097; A61F 2002/30991; A61F 2/2803; A61F 5/56; A61F 5/566; A61F 2005/563; A61C 19/045; A61C 19/05; A61C 19/06; A61C 19/063; A61C 11/00; A61C 7/08; A61C 7/36; A61C 9/0006; A61C 5/14; A61C 17/08; Y10S 602/902; A61M 37/00
USPC ..... 128/861, 848, 859; 433/6, 7
See application file for complete search history.

(56) References Cited

U.S. PATENT DOCUMENTS

| | | | | |
|---|---|---|---|---|
| 6,729,335 | B1 * | 5/2004 | Halstrom | A61F 5/566 128/859 |
| 2013/0087157 | A1 * | 4/2013 | Hawkins | A63B 71/085 264/16 |
| 2017/0001095 | A1 * | 1/2017 | Lovat | A63B 71/085 |

* cited by examiner

*Primary Examiner* — Ophelia A Hawthorne
*Assistant Examiner* — Michael Milo

(57) ABSTRACT

A supplement dispensing mouthguard device is an apparatus that readily supplies supplements into the mouth of a user while the user is performing an exercise. The apparatus includes an upper U-shaped platform, a lower U-shaped platform, an inner curved wall, an outer curved wall, a main fastener, a supplement reservoir, at least one inlet, and a plurality of outlets. The upper U-shaped platform and the lower U-shaped platform protects the teeth. The inner curved wall and the outer curved wall protects the tongue and the inner walls of the cheeks of the user. The main fastener connects the upper U-shaped platform with the lower U-shaped platform and seals the at least one inlet. The supplement reservoir contains the desired supplement. The at least one inlet provides access into the supplement reservoir. The plurality of outlets distributes the supplement into the mouth of the user.

14 Claims, 11 Drawing Sheets

SUPPLEMENT DISPENSING MOUTHGUARD DEVICE

The current application claims a priority to the U.S. provisional patent application Ser. No. 62/901,688 filed on Sep. 17, 2019.

FIELD OF THE INVENTION

The present invention generally relates to sports equipment and fitness accessories. More specifically, the present invention is a supplement dispensing mouthguard.

BACKGROUND OF THE INVENTION

Current methods of ingesting supplements during an exercise requires drinking from a workout bottle or eating a supplement in the form of solid foods. This requires an individual to carry additional items while working out as well as pause during a workout to consume supplements.

It is therefore an objective of the present invention to readily dispense supplement into the mouth of a user hands-free. The present invention is refillable and reliable, only dispensing the desired amount of supplement into the mouth of the user. The present invention allows a user to consume supplements throughout an exercise. The present invention also reduces the amount of gear a user must bring to a workout and carry throughout the workout. The present invention is a convenient replenishment for a user playing a sports game that does not easily allow a user to pause and consume a supplement. The present invention is also a convenient replenishment for a user participating in a race or marathon that is not able to carry many items throughout a course.

DETAIL DESCRIPTIONS OF THE INVENTION

Figure 1:
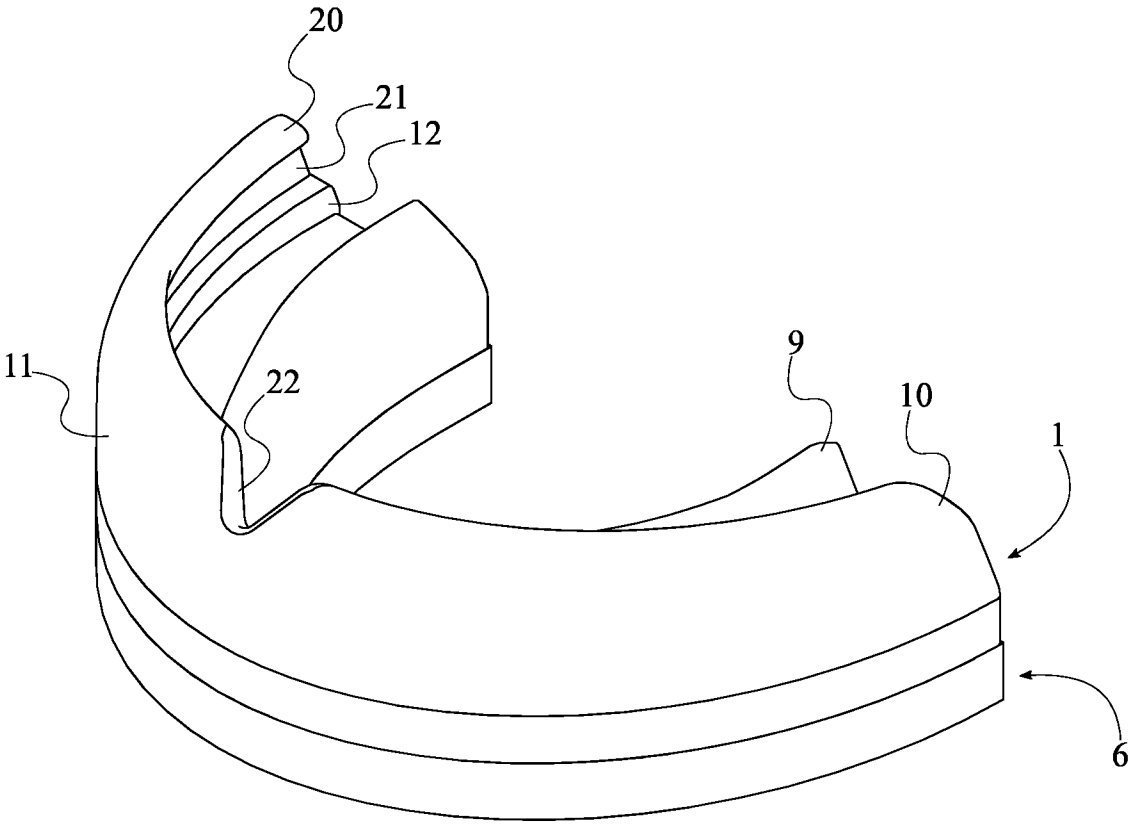
FIG. 1 is a perspective view of the present invention.

All illustrations of the drawings are for the purpose of describing selected versions of the present invention and are not intended to limit the scope of the present invention.

The present invention is a supplement dispensing mouthguard device. The present invention both stores and dispenses supplement directly into the mouth of a user, hands-free. The present invention preferably comprises shock absorbent material in order to also protect the interior of the moth. The supplement that is stored and dispensed with the present invention is preferably a liquid, a gel, or a paste that spreads evenly when ejected by the present invention. The supplement may boost energy and provide vitamins for better performance by the user. In order to engage the present invention hands-free, the user simply bites down on the present invention or presses the present invention with the tongue. The present invention both evenly and controllably distributes supplement within the mouth of the user while providing protection for the interior of the mouth of the user as the present invention may comprise an upper U-shaped platform 1, a lower U-shaped platform 6, an inner curved wall 9, an outer curved wall 10, a main fastener 13, a supplement reservoir 17, at least one inlet 18, and a plurality of outlet 19, seen in FIG. 1, FIG. 2, FIG. 3, FIG. 5, and FIG. 6. The upper U-shaped platform 1 and the lower U-shaped platform 6 protect the teeth of the user from grinding with each other. More specifically, the upper U-shaped platform 1 comprises an upper concave side 2 and an upper convex side 3. The upper concave side 2 presses against the tongue of the user, while the upper convex side 3 presses against the lip 20 of the user. The lower U-shaped platform 6 also seals the at least one inlet 18 with the main fastener 13. The inner curved wall 9 shields the tongue of the user from the teeth, and the outer curved wall 10 shields the lip 20 and inner cheeks of the user from the teeth as well. The main fastener 13 seals and exposes the at least one inlet 18 so that the user may have access to refill the supplement reservoir 17 through the at least one inlet 18. The supplement reservoir 17 stores the supplement and contains the supplement within the present invention while engaged within the mouth of a user. The at least one inlet 18 provides access into the supplement reservoir 17, and the plurality of outlet 19 provides a continuous exit for the supplement out of the supplement reservoir 17. It is understood that for various embodiments of the present invention, the plurality of outlet 19 may vary in amount and size. The plurality of outlet 19 may be positioned directly in front of the tongue of the user or distributed across the teeth of the user.

The overall configuration of the aforementioned components allows the present invention to be refillable and to readily eject a liquid, gel, or cream supplement into the mouth of the user. In order to access and close the at least one inlet 18, the upper U-shaped platform 1 is attached onto the lower U-shaped platform 6 by the main fastener 13. The outer curved wall 10 and the inner curved wall 9 is fixed onto the upper U-shaped platform 1, opposite the lower U-shaped platform 6. This arrangement, seen in FIG. 1 and FIG. 2, comfortably positions the present invention around the curvatures of the interior of the mouth while shielding the rest of the mouth from the upper row of teeth. More specifically, the outer curved wall 10 is positioned along the upper convex side 3, protecting both the lip 20 and inner cheeks of the user. Similarly, the inner curved wall 9 is positioned along the upper concave side 2, protecting the tongue. The supplement reservoir 17 is integrated into the inner curved wall 9 for a direct path for ingestion. The supplement reservoir 17 is refillable with the at least one inlet 18 as the at least one inlet 18 traverses through the upper U-shaped platform 1 and into the supplement reservoir 17. In the preferred embodiment of the present invention, the main fastener 13 is preferably positioned adjacent and along with the upper concave side 2, seen in FIG. 2, in order to directly engage with the at least one inlet 18 with the tongue and for the supplement to be directly ejected onto the tongue and towards the teeth of the user. The main fastener 13 is operatively coupled to the at least one inlet 18, wherein the main fastener 13 is used to open and close the at least one inlet 18, thereby sealing the at least one inlet 18 while the present invention is engaged within the mouth of the user. The plurality of outlet 19 traverses out of the supplement reservoir 17 and through the inner curved wall 9 and is oriented away from the outer curved wall 10. This arrangement provides a continuous flow of supplement from within the present invention onto the tongue and towards the teeth of the user.

Figure 3:
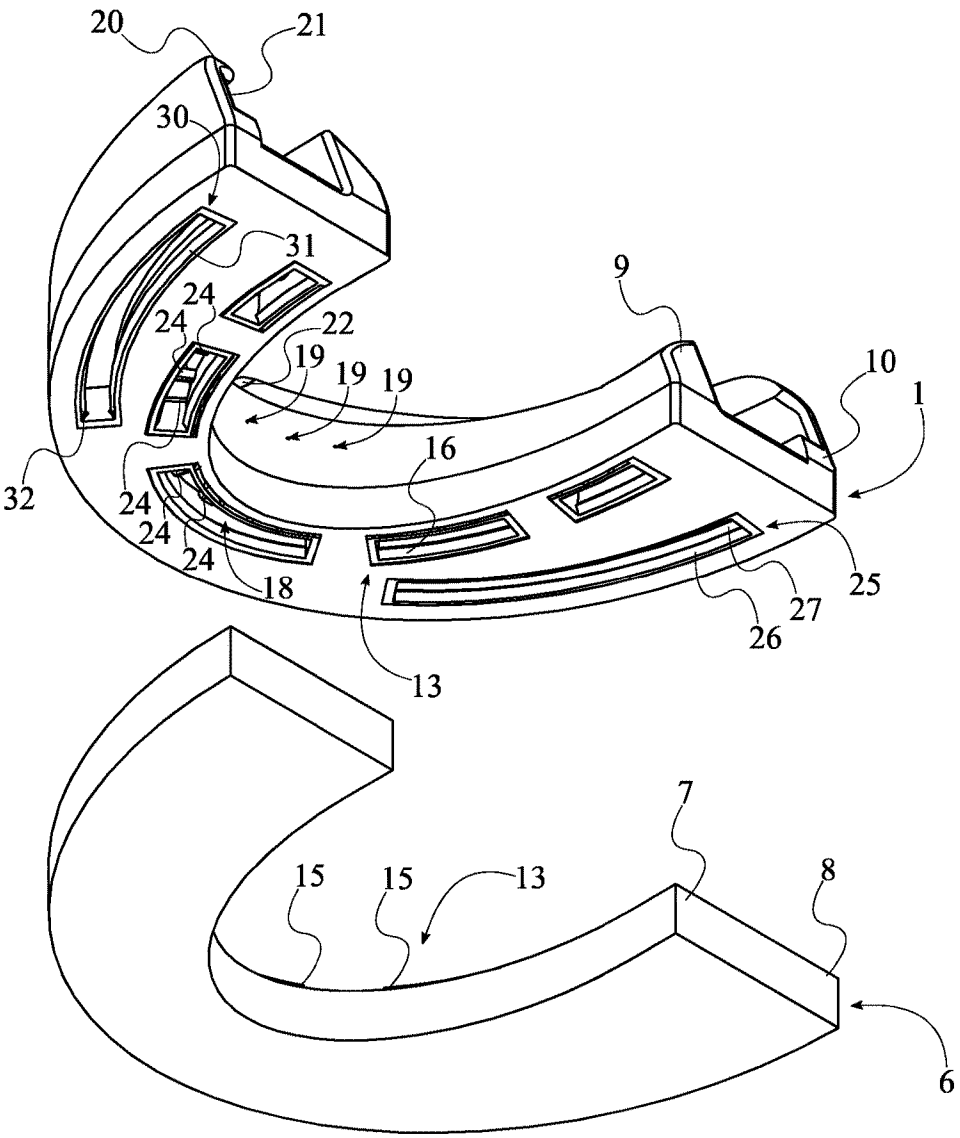
FIG. 3 is a bottom exploded view of the first embodiment of the present invention.
Figure 5:
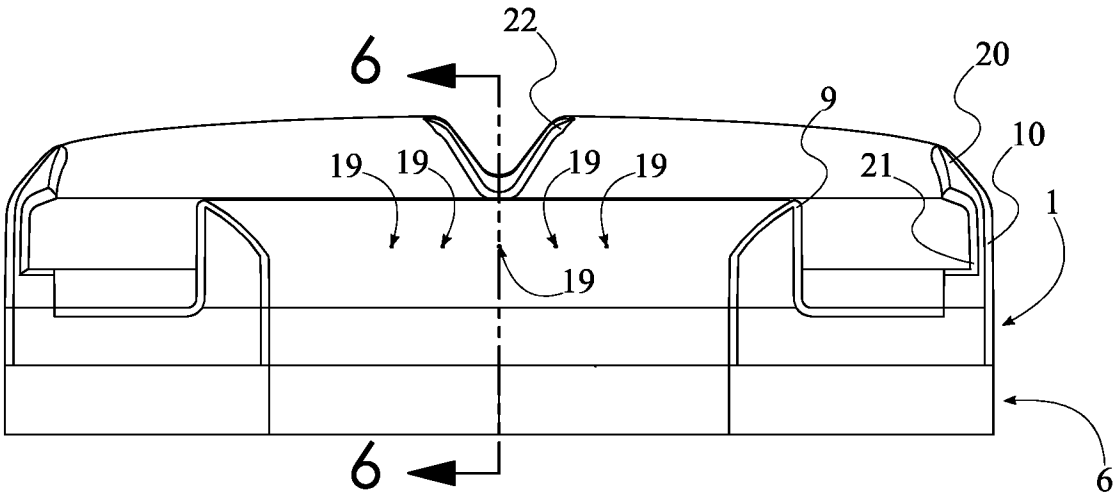
FIG. 5 is a rear side view of the present invention.

In order to fully protect the teeth and gums of the user, the present invention may further comprise a lip 20 and a groove 21, seen in FIG. 3 and FIG. 5. The lip 20 shields the upper gums of the user while being comfortably positioned around the upper gums. The groove 21 provides sufficient space for the upper row of teeth for the user while positioned in between the outer cured wall and the inner curved wall 9. Moreover, the outer curved wall 10 comprises a first surface 11 and a second surface 12. The first surface 11 is positioned opposite the second surface 12 about the outer curved wall 10. The second surface 12 is oriented towards the inner curved wall 9. The lip 20 is positioned around the upper gums of the user as the lip 20 is fixed adjacent with the outer curved wall 10, opposite the upper U-shaped platform 1. The lip 20 is angled towards the inner curved wall 9, accommodating the natural contours of the mouth. The groove 21 is integrated into the second surface 12 and is positioned across the outer curved wall 10, thereby being positioned adjacent with the upper row of teeth.

Figure 2:
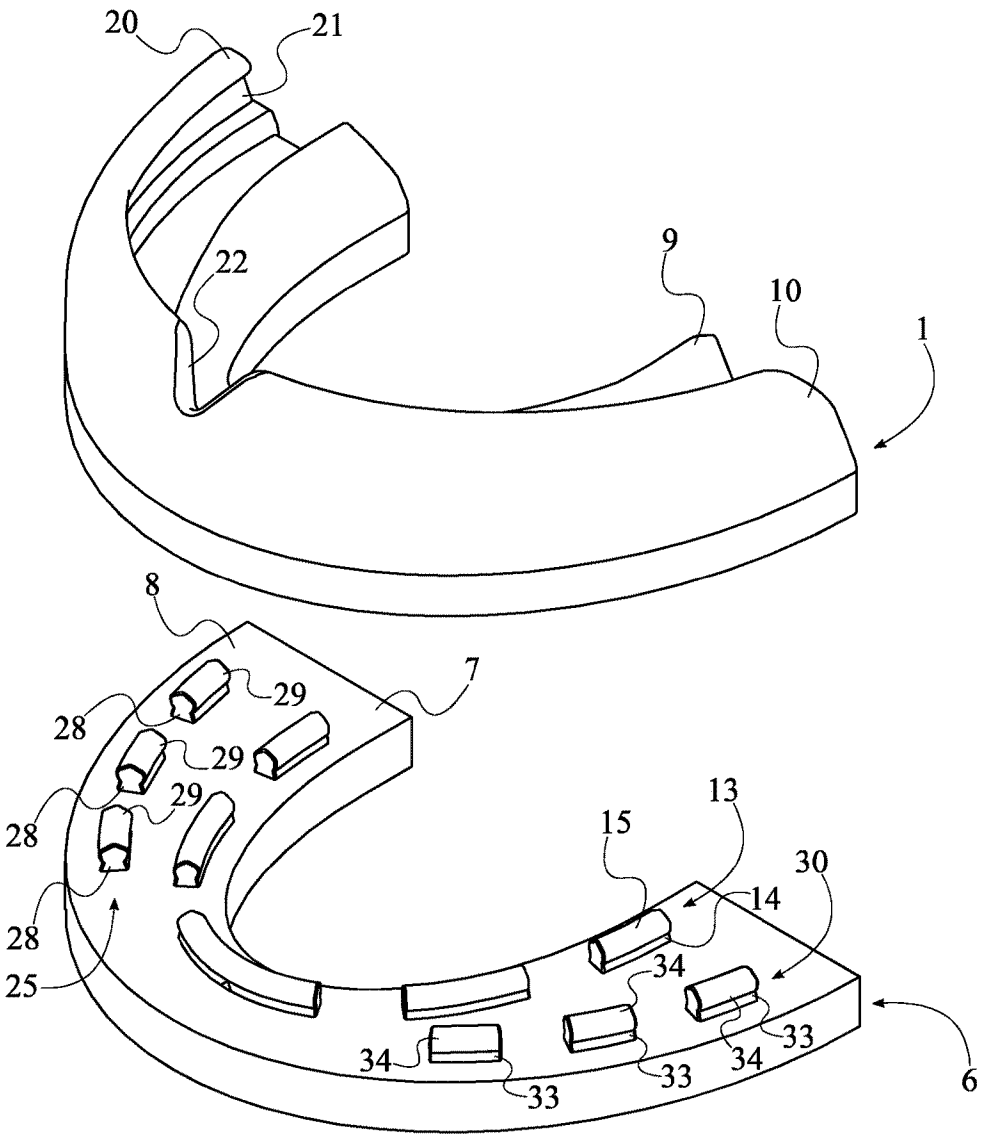
FIG. 2 is a top exploded view of a first embodiment of the present invention.
Figure 4:
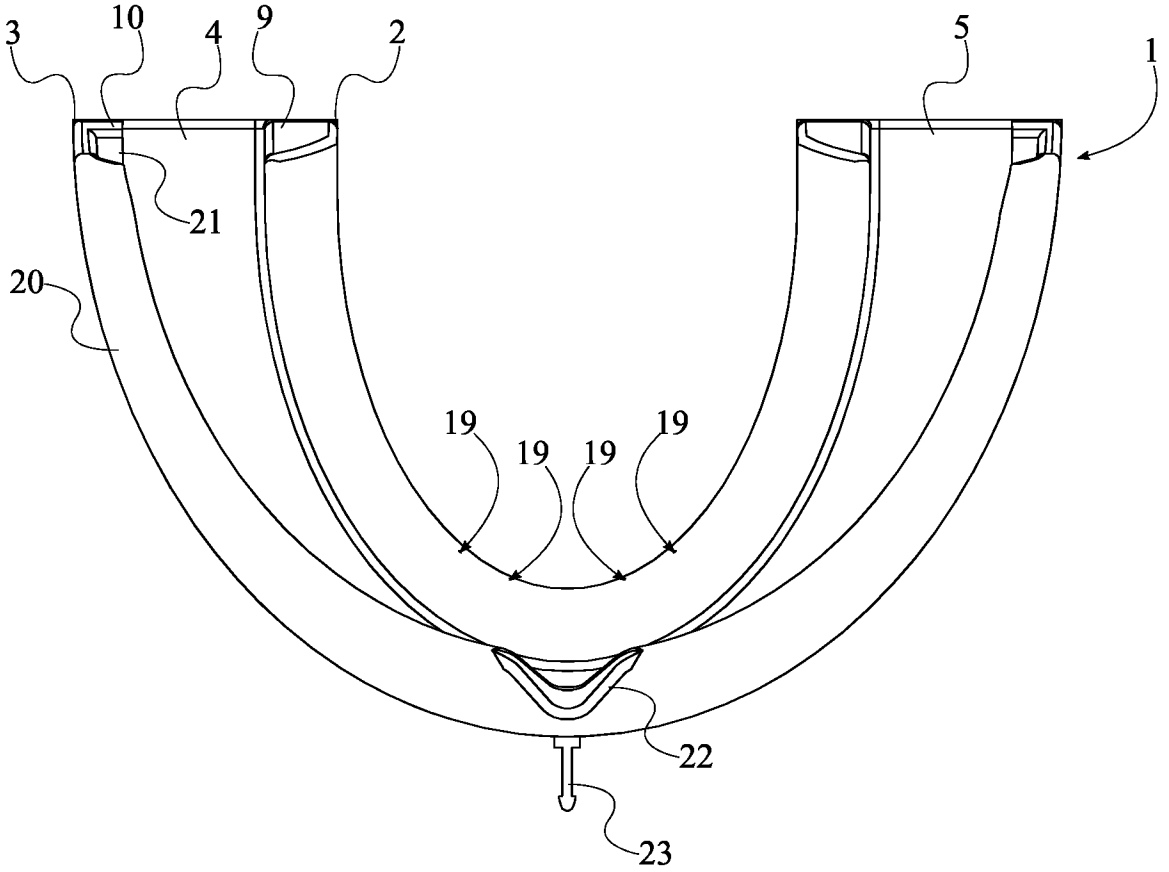
FIG. 4 is a top side view of an alternate embodiment of the present invention with a prong adapter.

The present invention is easily and comfortably used throughout exercise or high-performance exercise as the present invention may further comprise an airflow notch 22, seen in FIG. 1, FIG. 2, and FIG. 4. The airflow notch 22 allows the user to breathe into and out of the mouth while wearing the present invention. The airflow notch 22 traverses into the lip 20, opposite the outer curved wall 10 so as to provide a continuous flow of air into and out of the mouth, while preserving the structural integrity of the present invention. More specifically, the airflow notch 22 is centrally aligned along the lip 20.

An alternate embodiment of the present invention may be specifically used during sports games or sports practices and comprises a prong adapter 23, seen in FIG. 4. The prong adapter 23 provides a secure connection between the present invention and a helmet. The prong adapter 23 is positioned adjacent with the outer curved wall 10 for direct connection with a helmet. More specifically, the prong adapter 23 is fixed with the outer curved wall 10 and is oriented away from the inner curved wall 9 so that the prong adapter 23 does not come into contact with the teeth of the user.

Figure 6:
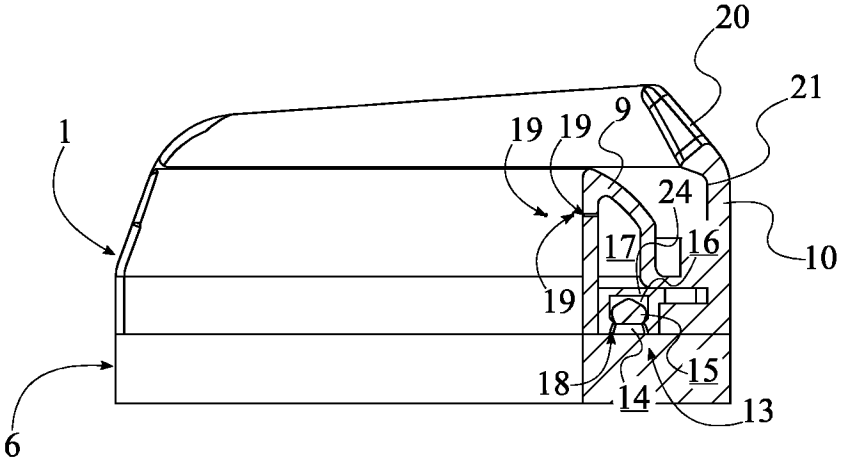
FIG. 6 is a cross-section view taken along line 6-6 in FIG. 5.
Figure 8:
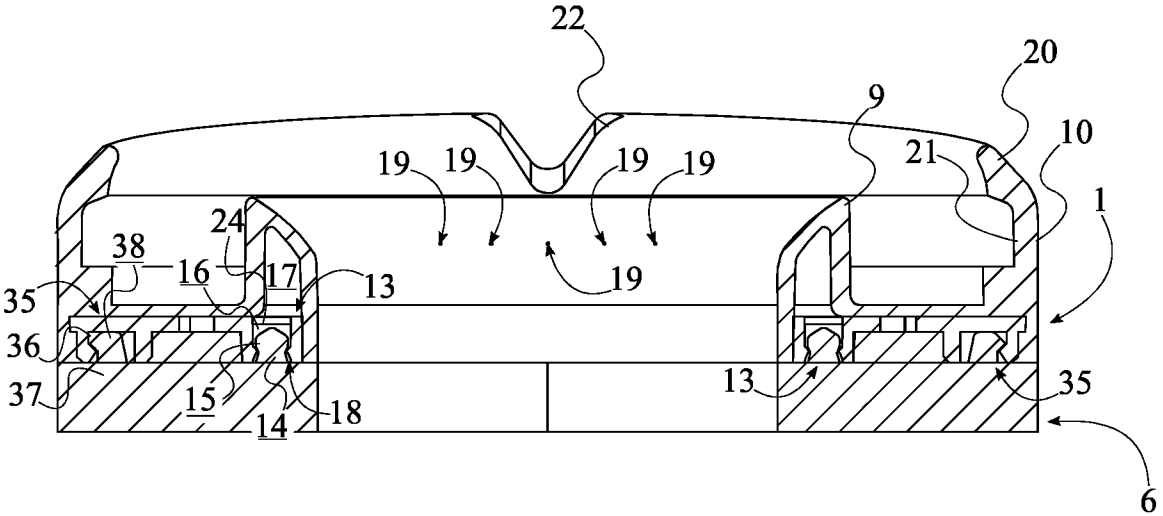
FIG. 8 is a cross-section view taken along line 8-8 in FIG. 7.

The supplement within the supplement reservoir 17 is evenly distributed into the mouth of the user as present invention may further comprise a plurality of trusses 24, seen in FIG. 3, FIG. 6, and FIG. 8. The plurality of trusses 24 serves as dividers so that the supplement is continuously ejected out of the plurality of outlet 19. The plurality of trusses 24 also enhances the structural integrity of the present invention, specifically the upper U-shaped platform 1. In order to evenly distribute the supplement, the plurality of trusses 24 is distributed along the at least one inlet 18, and each of the plurality of trusses 24 is positioned across the at least one inlet 18. More specifically, the plurality of trusses 24 is fixed within the at least one inlet 18 and is positioned offset the lower U-shaped platform 6.

Figure 11:
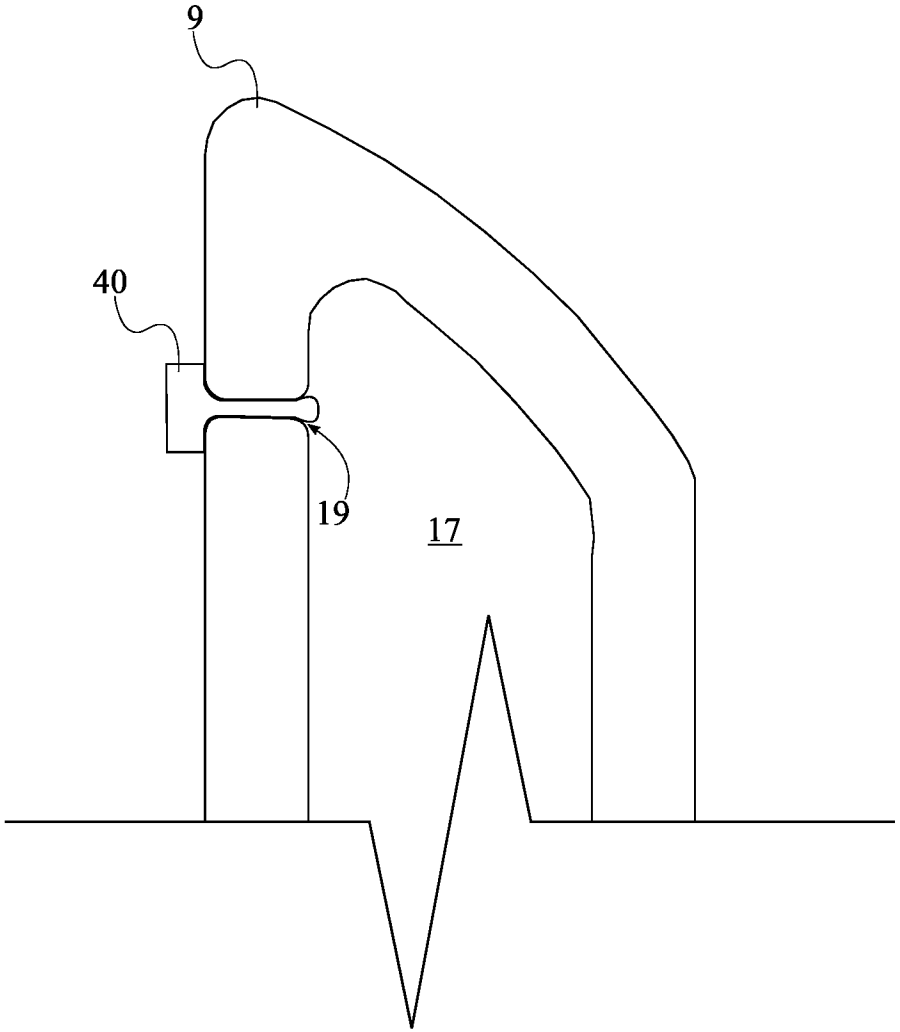
FIG. 11 is a schematic view of at least one plug engaged within at least one selected outlet of a plurality of outlets of the present invention.

In order to control the flow of supplement exiting the plurality of outlets 19, alternate embodiments of the present invention may further comprise at least one plug 40, seen in FIG. 11. The at least one plug 40 stops the supplement within the supplement reservoir 17 from exiting through a selected outlet of the plurality of outlets 19. It is understood that the at least one plug 40 comprises a plurality of plugs in order to block the flow of supplement from multiple outlets of the plurality of outlets 19, simultaneously. The at least one plug 40 is hermetically mounted into the at least one selected outlet from the plurality of outlets 19, thereby effectively directing the supplement through the remaining outlets of the plurality of outlets 19.

In order for the at least one inlet 18 to be securely sealed in a closed configuration, the main fastener 13 may comprise a main rim 14, an elongated tab 15, and an elongated notch 16, seen in FIG. 1, FIG. 3, FIG. 6, and FIG. 8. The main rim 14 positions and orients the elongated tab 15, and the elongated tab 15 seals the at least one inlet 18. The elongated notch 16 provides space for the elongated tab 15 within the at least one inlet 18 while anchoring the elongated tab 15 within the at least one inlet 18. Similar with the upper U-shaped platform 1, the lower U-shaped platform 6 comprise a lower concave side 7 and a lower convex side 8. The lower concave side 7 presses against the tongue of the user, and the lower convex side 8 presses against the lower lip 20 of the user. The main rim 14 is fixed onto the lower U-shaped platform 6, adjacent the upper U-shaped platform 1, and is positioned along with the lower concave side 7. This arrangement positions the main fastener 13 in between the lower U-shaped platform 6 and the upper U-shaped platform 1. The elongated tab 15 directly engages with the at least one inlet 18 as the elongated tab 15 is positioned adjacent with the main rim 14, opposite the lower U-shaped platform 6, and is fixed along the main rim 14. The elongated notch 16 is integrated into the at least one inlet 18 and is positioned offset with the lower U-shaped platform 6, thereby allowing the elongated tab 15 to latch into the at least one inlet 18. The lower U-shaped platform 6 is easily connected and disconnected with each other as the main rim 14 is slidably engaged within the at least one inlet 18. Furthermore, this arrangement preserves the structural integrity of the main fastener 13 while providing a more secure connection between the elongated tab 15 and the lower U-shaped platform 6. The elongated notch 16 is engaged by the elongated tab 15, effectively sealing the at least one inlet 18.

The present invention effectively protects the interior of the mouth and provides a secure seal of the at least one inlet 18 as a first embodiment of the present invention may further comprise a left supplementary fastener 25 and a right supplementary fastener 30, seen in FIG. 2 and FIG. 3. The left supplementary fastener 25 and the right supplementary fastener 30 further reinforces the connection between the upper U-shaped platform 1 and the lower U-shaped platform 6 around the supplement reservoir 17. Consequently, connection of the elongated tab 15 within the elongated notch 16 is further reinforced as well. The upper U-shaped platform 1 further comprises a left upper end 4 and a right upper end 5, accommodating the left side and the right side of the mouth. The left side of the present invention is secured with the left supplementary fastener 25 as the left supplementary fastener 25 is positioned adjacent with the left upper end 4 and is positioned offset and along with the main fastener 13. The upper U-shaped platform 1 is operatively coupled with the lower U-shaped platform 6 by the left supplementary fastener 25, wherein the left supplementary fastener 25 is used to attach and detach the upper U-shaped platform 1 with the lower U-shaped platform 6. The upper U-shaped platform 1 therefore remains superimposed across the lower U-shaped platform 6 while positioned within the mouth of the user.

The upper U-shaped platform 1 and the lower U-shaped platform 6 remain easily connected and disconnected with each other by the user as the left supplementary fastener 25 preferably comprises a first supplementary track 26, a first supplementary notch 27, a plurality of first bar bodies 28, and a plurality of first tabs 29, also seen in FIG. 2 and FIG. 3. The first supplementary track 26 and the first supplementary notch 27 allows the plurality of first bar bodies 28 and the plurality of first tabs 29 to be positioned into the upper U-shaped platform 1. The plurality of first bar bodies 28 positions and orients the plurality of first tabs 29, and the plurality of first tabs 29 latches into the first supplementary notch 27. In order to preserve the structural integrity of the upper U-shaped platform 1 while allowing the left supplementary fastener 25 to engage with the upper U-shaped platform 1, the first supplementary track 26 is integrated into the upper U-shaped platform 1, opposite to both the outer curved wall 10 and the inner curved wall 9. Moreover, the first supplementary notch 27 is integrated into the first supplementary track 26. The first supplementary notch 27 is positioned along the first supplementary track 26 and offset with the lower U-shaped platform 6 so that the plurality of first tabs 29 may anchor into the first supplementary notch 27. The lower U-shaped platform 6 is further secured with the upper U-shaped platform 1 as the plurality of first bar bodies 28 is fixed adjacent and along the lower U-shaped platform 6. The plurality of first tabs 29 directly latches into the first supplementary notch 27 as each of the plurality of first tabs 29 is fixed adjacent with a corresponding first bar body of the plurality of first bar bodies 28, opposite the lower U-shaped platform 6. Similar with the main fastener 13, the lower U-shaped platform 6 is easily connected and disconnected with each other as the plurality of first bar bodies 28 is slidably engaged within the first supplementary track 26. The first supplementary notch 27 is engaged by the plurality of first tabs 29, securely connecting the lower U-shaped platform 6 with the upper U-shaped platform 1.

Similarly, the right side of the present invention is secured with the right supplementary fastener 30 as the right supplementary fastener 30 is positioned adjacent with the right upper end 5 and is positioned offset and along with the main fastener 13, seen in FIG. 2 and FIG. 3. The upper U-shaped platform 1 is operatively coupled with the lower U-shaped platform 6 by the right supplementary fastener 30, wherein the right supplementary fastener 30 is used to attach and detach the upper U-shaped platform 1 with the lower U-shaped platform 6. The upper U-shaped platform 1 therefore remains superimposed across the lower U-shaped platform 6 while positioned within the mouth of the user.

The upper U-shaped platform 1 and the lower U-shaped platform 6 remain easily connected and disconnected with each other by the user as the right supplementary fastener 30 preferably comprises a second supplementary track 31, a second supplementary notch 32, a plurality of second bar bodies 33, and a plurality of second tabs 34, also seen in FIG. 2 and FIG. 3. The second supplementary track 31 and the second supplementary notch 32 allows the plurality of second bar bodies 33 and the plurality of second tabs 34 to be positioned into the upper U-shaped platform 1. The plurality of second bar bodies 33 positions and orients the plurality of second tabs 34, and the plurality of second tabs 34 latches into the second supplementary notch 32. In order to preserve the structural integrity of the upper U-shaped platform 1 while allowing the right supplementary fastener 30 to engage with the upper U-shaped platform 1, the second supplementary track 31 is integrated into the upper U-shaped platform 1, positioned opposite to both the outer curved wall 10 and the inner curved wall 9. Moreover, the second supplementary notch 32 is integrated into the second supplementary track 31. The second supplementary notch 32 is positioned along the second supplementary track 31 and offset with the lower U-shaped platform 6 so that the plurality of second tabs 34 may anchor into the second supplementary notch 32. The lower U-shaped platform 6 is further secured with the upper U-shaped platform 1 as the plurality of second bar bodies 33 is fixed adjacent and along the lower U-shaped platform 6. The plurality of second tabs 34 directly latches into the second supplementary notch 32 as each of the plurality of second tabs 34 is fixed adjacent with a corresponding second bar body of the plurality of second bar bodies 33, opposite the lower U-shaped platform 6. Similar with the main fastener 13, the lower U-shaped platform 6 is easily connected and disconnected with each other as the plurality of second bar bodies 33 is slidably engaged within the second supplementary track 31. The second supplementary notch 32 is engaged by the plurality of second tabs 34, securely connecting the lower U-shaped platform 6 with the upper U-shaped platform 1.

Figure 7:
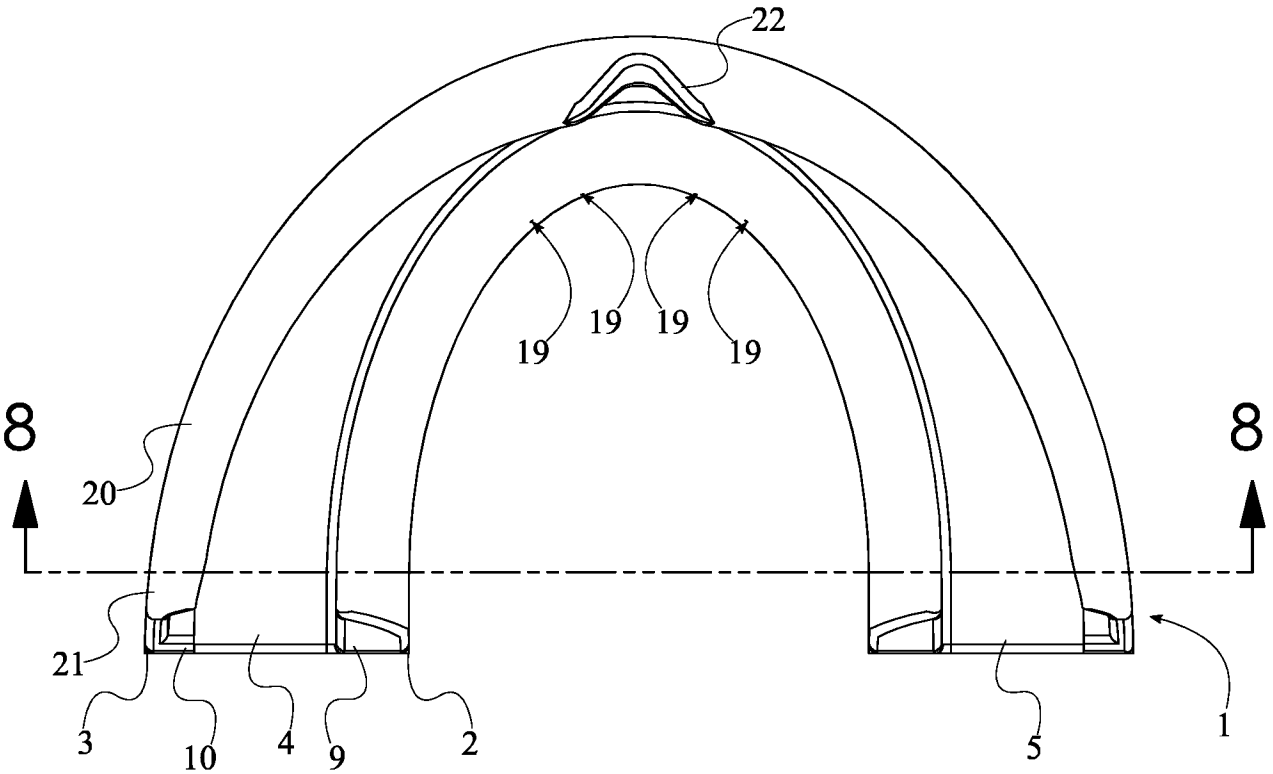
FIG. 7 is a top side view of a second embodiment of the present invention.

Similar with the first embodiment of the present invention, a second embodiment of the present invention, seen in FIG. 7 and FIG. 8, comprises a plurality of third supplementary fasteners 35. The plurality of third supplementary fasteners 35 also provide a more secure connection between the upper U-shaped platform 1 and the lower U-shaped platform 6. Consequently, the seal of the at least one inlet 18 by the elongated tab 15 and the elongated notch 16 is further secured as well. Each of the third supplementary fasteners comprises a notch 36, a post 37, and a hook 38. The notch 36 provides space for the hook 38 within the upper U-shaped platform 1. The post 37 positions and orients the hook 38. The hook 38 latches into the notch 36, connecting the lower U-shaped platform 6 with the upper U-shaped platform 1. The upper U-shaped platform 1 remains superimposed across the lower U-shaped platform 6 as the plurality of third supplementary fasteners 35 is positioned offset and along with the main fastener 13. The notch 36 traverses into the upper U-shaped platform 1 so that the hook 38 may latch into the upper U-shaped platform 1. The post 37 is fixed adjacent with the lower U-shaped platform 6, and the hook 38 is fixed adjacent with the post 37, opposite the lower U-shaped platform 1. This arrangement allows of the lower U-shaped platform 6 to remain directly against the upper U-shaped platform 1. The notch 36 is engaged by the hook 38, thereby further securing the lower U-shaped platform 6 and the upper U-shaped platform 1 with the plurality of third supplementary fasteners 35.

Figure 9:
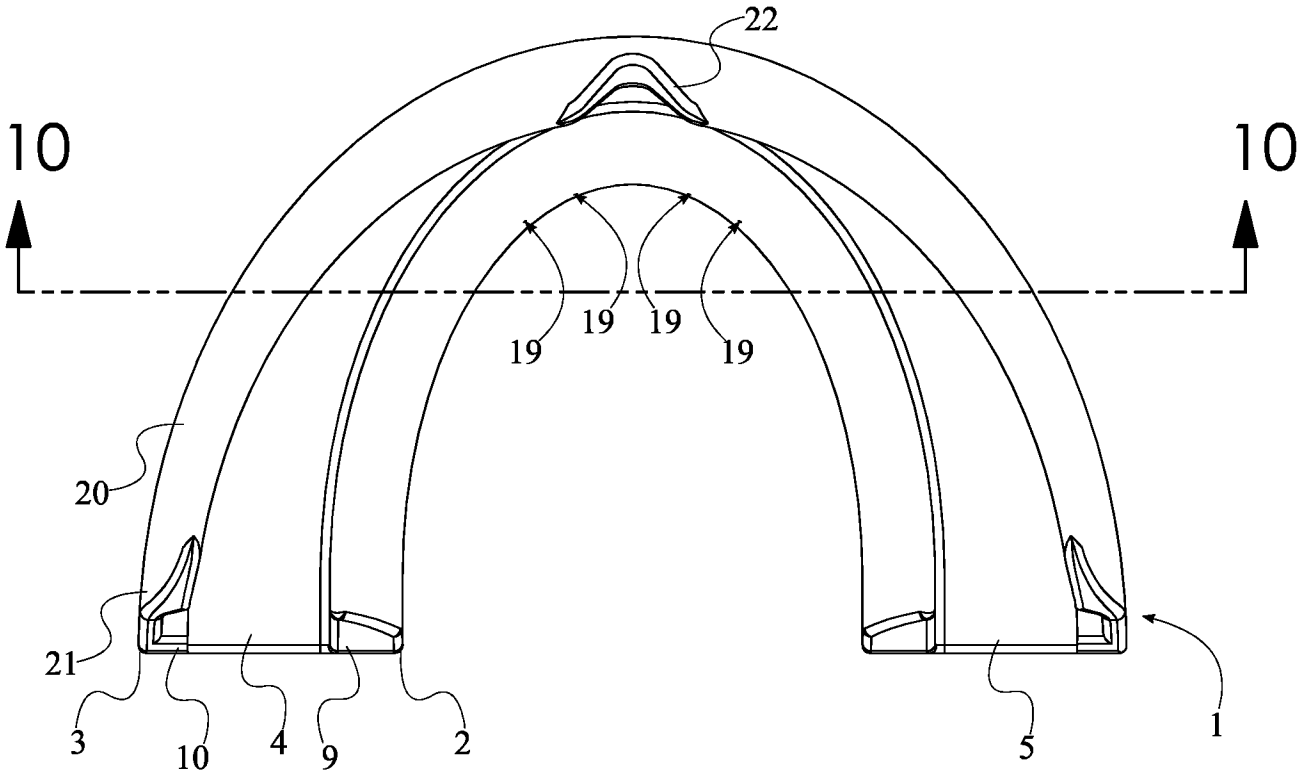
FIG. 9 is a top side view of a third embodiment of the present invention.
Figure 10:
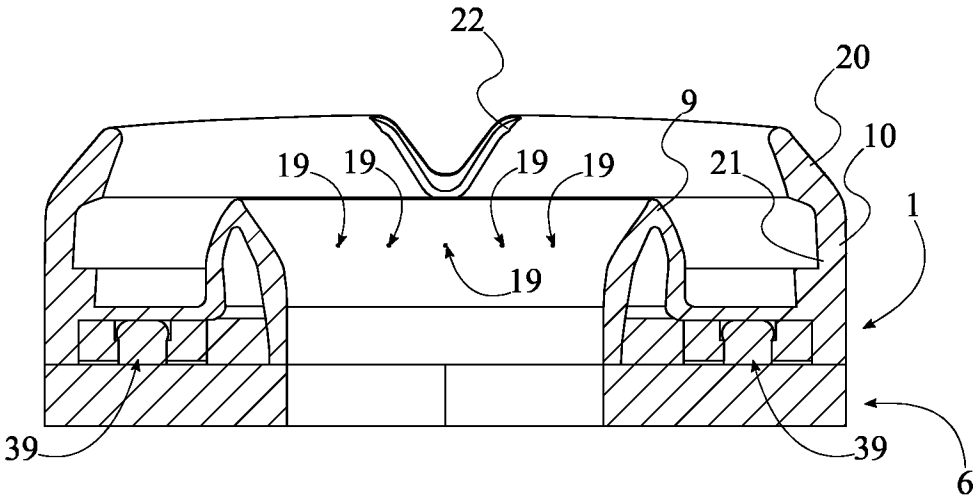
FIG. 10 is a cross-section view taken along line 10-10 in FIG. 9.

Similar with the first embodiment and the second embodiment of the present invention, a third embodiment of the present invention comprises a plurality of ball-and-socket fittings 39, seen in FIG. 9 and FIG. 10. The plurality of ball-and-socket fittings 39 also provides a more secure connection between the upper U-shaped platform 1 and the lower U-shaped platform 6. Consequently, the seal of the at least one inlet 18 by the elongated tab 15 and the elongated notch 16 is further secured as well. The upper U-shaped platform 1 remains superimposed across the lower U-shaped platform 6 as the plurality of ball-and-socket fittings 39 is positioned offset and along with the main fastener 13. The upper U-shaped platform 1 is operatively coupled with the lower U-shaped platform 6 by the plurality of ball-and-socket fittings 39, wherein each of the plurality of ball-and-socket fittings 39 is used to attach and detach the upper U-shaped platform 1 with the lower U-shaped platform 6. The lower U-shaped platform 6 and the upper U-shaped platform 1 are therefore further secured with the plurality of ball-and-socket fittings 39.

Although the invention has been explained in relation to its preferred embodiment, it is to be understood that many other possible modifications and variations can be made without departing from the spirit and scope of the invention as hereinafter claimed.

What is claimed is:

1. A supplement dispensing mouthguard device comprises:

an upper U-shaped platform;

a lower U-shaped platform;

an inner curved wall;

an outer curved wall;

a main fastener;

a supplement reservoir;

at least one inlet;

a plurality of outlets;

the upper U-shaped platform comprises an upper concave side and an upper convex side;

the upper U-shaped platform being attached onto the lower U-shaped platform by the main fastener;

the outer curved wall and the inner curved wall being fixed onto the upper U-shaped platform, opposite the lower U-shaped platform;

the outer curved wall being positioned along the upper convex side;

the inner curved wall being positioned along the upper concave side;

the supplement reservoir being integrated into the inner curved wall;

the at least one inlet traversing through the upper U-shaped platform and into the supplement reservoir;

the main fastener being operatively coupled to the at least one inlet, wherein the main fastener is used to open and close the at least one inlet;

the plurality of outlets traversing out of the supplement reservoir and through the inner curved wall; and, the plurality of outlets being oriented away from the outer curved wall.

2. The supplement dispensing mouthguard device as claimed in claim 1 comprises:

a lip;

a groove;

the outer curved wall comprises a first surface and a second surface;

the first surface being positioned opposite the second surface about the outer curved wall;

the second surface being oriented towards the inner curved wall;

the lip being fixed adjacent with the outer curved wall, opposite the upper U-shaped platform;

the lip being angled towards the inner curved wall;

the groove being integrated into the second surface; and, the groove being positioned across the outer curved wall.

3. The supplement dispensing mouthguard device as claimed in claim 2 comprises:

an airflow notch;

the airflow notch traversing into the lip, opposite the outer curved wall; and, the airflow notch being centrally aligned along the lip.

4. The supplement dispensing mouthguard device as claimed in claim 1 comprises:

a left supplementary fastener;

the upper U-shaped platform comprises a left upper end;

the left supplementary fastener being positioned adjacent with the left upper end;

the left supplementary fastener being positioned offset and along with the main fastener; and, the upper U-shaped platform being operatively coupled with the lower U-shaped platform by the left supplementary fastener, wherein the left supplementary fastener is used to attach and detach the upper U-shaped platform with the lower U-shaped platform.

5. The supplement dispensing mouthguard device as claimed in claim 4 comprises:

the left supplementary fastener comprises a first supplementary track, a first supplementary notch, a plurality of first bar bodies, and a plurality of first tabs;

the first supplementary track being integrated into the upper U-shaped platform, opposite to both the outer curved wall and the inner curved wall;

the first supplementary notch being integrated into the first supplementary track;

the first supplementary notch being positioned along the first supplementary track;

the first supplementary notch being positioned offset with the lower U-shaped platform;

the plurality of bar bodies being fixed adjacent and along the lower U-shaped platform;

each of the plurality of first tabs being fixed adjacent with a corresponding first bar body of the plurality of first bar bodies, opposite the lower U-shaped platform;

the plurality of first bar bodies being slidably engaged within the first supplementary track; and, the first supplementary notch being engaged by the plurality of first tabs.

6. The supplement dispensing mouthguard device as claimed in claim 1 comprises:

a right supplementary fastener;

the upper U-shaped platform comprises a right upper end;

the right supplementary fastener being positioned adjacent with the right upper end;

the right supplementary fastener being positioned offset and along with the main fastener; and, the upper U-shapeed platform being operatively coupled with the lower U-shaped platform by the right supplementary fastener, wherein the right supplementary fastener is used to attach and detach the upper U-shaped platform with the lower U-shaped platform.

7. The supplement dispensing mouthguard device as claimed in claim 6 comprises:

the right supplementary fastener comprises a second supplementary track, a second supplementary notch, a plurality of second bar bodies, and a plurality of second tabs;

the second supplementary track being integrated into the upper U-shaped platform, positioned opposite to both the outer curved wall and the inner curved wall;

the second supplementary notch being integrated into the second supplementary track;

the second supplementary notch being positioned along the second supplementary track;

the second supplementary notch being positioned offset with the lower U-shaped platform;

the plurality of second bar bodies being fixed adjacent and along the lower U-shaped platform;

each of the plurality of second tabs being fixed adjacent with a corresponding second bar body of the plurality of second bar bodies, opposite the lower U-shaped platform;

the plurality of second bar bodies being slidably engaged within the second supplementary track; and, the second supplementary notch being engaged by the plurality of second tabs.

8. The supplement dispensing mouthguard device as claimed in claim 1 comprises:

a prong adapter;

the prong adapter being positioned adjacent with the outer curved wall;

the prong adapter being fixed with the outer curved wall; and, the prong adapter being oriented away from the inner curved wall.

9. The supplement dispensing mouthguard device as claimed in claim 1 comprises:

a plurality of trusses;

the plurality of trusses being distributed along the at least one inlet;

each of the plurality of trusses being positioned across the at least one inlet;

the plurality of trusses being fixed within the at least one inlet; and, the plurality of trusses being positioned offset the lower U-shaped platform.

10. The supplement dispensing mouthguard device as claimed in claim 1 comprises:

at least one plug; and, the at least one plug being hermetically mounted into at least one selected outlet from the plurality of outlets.

11. The supplement dispensing mouthguard device as claimed in claim 1 comprises:

the main fastener comprises a main rim, an elongated tab, and an elongated notch;

the lower U-shaped platform comprises a lower concave side and a lower convex side;

the main rim being fixed onto the lower U-shaped platform, adjacent the upper U-shaped platform;

the main rim being positioned along the lower concave side;

the elongated tab being positioned adjacent with the main rim, opposite the lower U-shaped platform;

the elongated tab being fixed along the main rim;

the elongated notch being integrated into the at least one inlet;

the elongated notch being positioned offset with the lower U-shaped platform;

the main rim being slidably engaged within the at least one inlet; and, the elongated notch being engaged by the elongated tab.

12. The supplement dispensing mouthguard device as claimed in claim 1 comprises:

a plurality of third supplementary fasteners;

each of the third supplementary fasteners comprises a notch, a post, and a hook;

the plurality of third supplementary fasteners being positioned offset and along with the main fastener;

the notch traversing into the upper U-shaped platform;

the post being fixed adjacent with the lower U-shaped platform;

the hook being fixed adjacent with the post, opposite the lower U-shaped platform; and, the notch being engaged by the hook.

13. The supplement dispensing mouthguard device as claimed in claim 1 comprises:

a plurality of ball-and-socket fittings;

the plurality of ball-and-socket fittings being positioned offset and along with the main fastener; and, the upper U-shaped platform being operatively coupled with the lower U-shaped platform by the plurality of ball-and-socket fittings, wherein each of the plurality of ball-and-socket fittings is used to attach and detach the upper U-shaped platform with the lower U-shaped platform.

14. The supplement dispensing mouthguard device as claimed in claim 1 comprises:

the main fastener being positioned adjacent and along with the upper concave side.

* * * * *